US005881818A

United States Patent [19]

Lee et al.

[11] Patent Number: 5,881,818

[45] Date of Patent: Mar. 16, 1999

[54] FOAM FREE TEST SYSTEM FOR USE WITH FIRE FIGHTING VEHICLES

[75] Inventors: T. Richard Lee, Thousand Oaks; Rance T. Kudo, Oxnard; Jesse L. McNolty, Santa Paula; Raymond J. Cappillino, Oxnard, all of Calif.

[73] Assignee: The United States of America as represented by the Secretary of the Navy, Washington, D.C.

[21] Appl. No.: 954,890

[22] Filed: Oct. 6, 1997

[51] Int. Cl.[6] ..... A62C 35/00

[52] U.S. Cl. ..... 169/15; 239/318; 239/305

[58] Field of Search ..... 239/318, 393, 239/310, 10, 304, 305, 307; 169/54, 15

[56] References Cited

U.S. PATENT DOCUMENTS

| | | | |
|---|---|---|---|
| 3,393,745 | 7/1968 | Durstewitz | 169/15 |
| 4,246,969 | 1/1981 | McLoughlin et al. | 169/15 |
| 4,474,680 | 10/1984 | Knoll | 169/15 |
| 4,526,234 | 7/1985 | Little | 169/15 |
| 4,645,009 | 2/1987 | Hawelka et al. | 169/15 |
| 4,732,181 | 3/1988 | Sollander et al. | 169/15 |

*Primary Examiner*—Kevin Weldon
*Attorney, Agent, or Firm*—David S. Kalmbaugh

[57] ABSTRACT

A test system for use in testing Aircraft Rescue Fire Fighting and Structural Pumper vehicles equipped with fire fighting foam distribution systems. The dye piping arrangement for the test system uses a dye concentrate and water mixture which are delivered into the dye water foam free test system through a three way ball valve, a proportioner and eductor. Fluid flow through the eductor generates a vacuum or negative pressure within the eductor. The dye concentrate from a dye storage bottle is then suctioned into the foam distribution system by the negative pressure within the eductor. A needle valve, check valve and a dye solenoid valve are included in the system. The needle valve meters the amount of dye suctioned into the dye water foam distribution system. The check valve prevents any fluids from back flowing into the dye concentrate tank. The normally closed dye solenoid valve is remotely operated by an ON-POWER OFF-OFF three position switch. The switch is turned ON to provide for dye concentrate flow in the system. A digital monitor is also provided for use by the operator to read flow rate in gallons per minute during system operation. The dye concentrates used during testing are environmentally benign and biodegradable.

20 Claims, 4 Drawing Sheets

FOAM FREE TEST SYSTEM FOR USE WITH FIRE FIGHTING VEHICLES

BACKGROUND OF THE INVENTION

1. Field of the Invention

The present invention relates generally to fire fighting systems for use in fighting and extinguishing hydrocarbon and other flammable liquid fires. More particularly, the present invention relates to a foam free test kit for testing Aircraft Rescue Fire Fighting and Structural Pumper vehicles equipped with fire fighting foam distribution systems that must be routinely tested to ensure these systems operate correctly during fire fighting missions.

2. Description of the Prior Art

Presently, Aqueous Film Forming Foam, which is commercially available, and is defined in Military Specification MIL-F-24358, is the most commonly used fire fighting foam currently on the market. Aqueous film forming foam, is a very effective fire fighting foam for extinguishing hydrocarbon and other flammable liquid fires. Aqueous film forming foam has the quality of being able to spread an aqueous film on the surface of hydrocarbon liquids, enhancing the speed of extinguishment.

Aqueous Film Forming Foam are particularly advantageous in that they are designed to be used with water or seawater. When proportioned with water and applied with conventional foam or water/fog equipment, foam is generated. The foam spreads over the surface of the burning material forming a blanket in the manner of conventional foam. An aqueous solution drains from the foam bubbles and forms a vapor sealing film that floats on the surface of the burning matter and suppresses any volatile vapors, sparks, or the like.

The U.S. military, including the Navy, procures several hundred thousand gallons of Aqueous Film Forming Foam annually for use with shipboard fire fighting systems, aircraft hanger automated sprinkler systems, fire trucks, and fire fighting training and equipment testing. The amount of Aqueous Film Forming Foam used for equipment test and fire fighting training by the military is about 20 percent of the annual purchase of Aqueous Film Forming Foam.

There is a need to test fire fighting systems, especially crash fire rescue vehicles, which use Aqueous Film Forming Foam since these systems are not very reliable. These systems tests conducted monthly, weekly and sometimes daily to insure that the fire fighting systems are operating effectively and efficiently.

The frequent testing is creating a problem environmentally. Aqueous Film Forming Foam includes two components fluorocarbon surfactant and butyl carbitol which are toxic to shellfish and other organisms. Because of the environmental problems associated with Aqueous Film Forming Foam, foam waste water discharge on to the ground and to waste treatment facilities is prohibited.

Further, the cost of containment facilities to collect and/or treat hazardous waste and the disposal cost of Aqueous Film Forming Foam are preventing the timely testing of fire fighting equipment in accordance with the National Fire Protection Association fire code standards.

Since an environmentally safe formulation of Aqueous Film Forming Foam will not be commercially available in the immediate future, there is a need to develop a test system for the testing of fire fighting equipment which is effective, efficient and highly reliable and does not require the use of Aqueous Film Forming Foam during the test.

SUMMARY OF THE INVENTION

The foam free test system of the present invention overcomes some of the disadvantages of the prior art including those mentioned above in that it comprises a relatively simple, yet highly effective test system which is adapted for use in testing Aircraft Rescue Fire Fighting and Structural Pumper vehicles equipped with fire fighting foam distribution systems that must be routinely tested to ensure these systems operate correctly during fire fighting missions.

The dye piping arrangement for the test system uses a dye concentrate and water mixture which are delivered into the dye-water foam-free test system through a three way ball valve, a proportioner and eductor. Fluid flow through the eductor generates a vacuum or negative pressure within the eductor. The dye concentrate from a dye storage bottle is then suctioned into the foam distribution system by the negative pressure within the eductor.

A needle valve, check valve and a dye solenoid valve are included in the system. The needle valve meters the amount of dye suctioned into the foam distribution system. The check valve prevents any fluids from back flowing into the dye storage bottle.

The normally closed dye solenoid valve is remotely operated by an ON-POWER OFF-OFF three position switch on a control panel located in the cab of the fire fighting vehicle. The switch is turned ON to provide for dye concentrate flow in the system and OFF for no dye concentrate during the dye-water foam-free system tests.

A digital monitor is also provided for use by the operator to read flow rate in gallons per minute during system operation. The dye concentrates used during testing are environmentally benign and biodegradable.

DETAILED DESCRIPTION OF THE PREFERRED EMBODIMENT

Figure 1A:
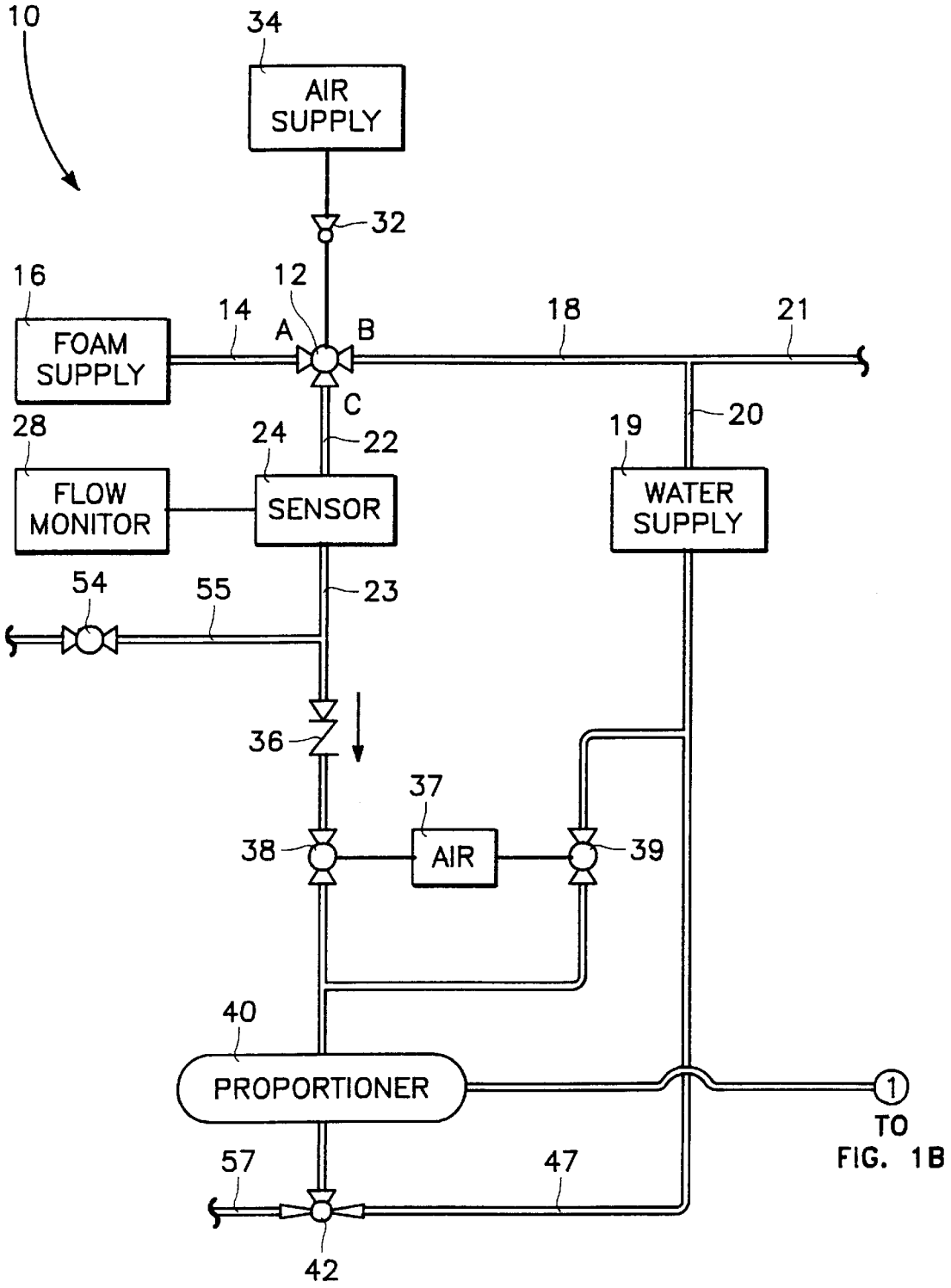
FIGS. 1A and 1B is a fluid flow schematic diagram of the foam free test kit for use with fire fighting vehicles.
Figure 1B:
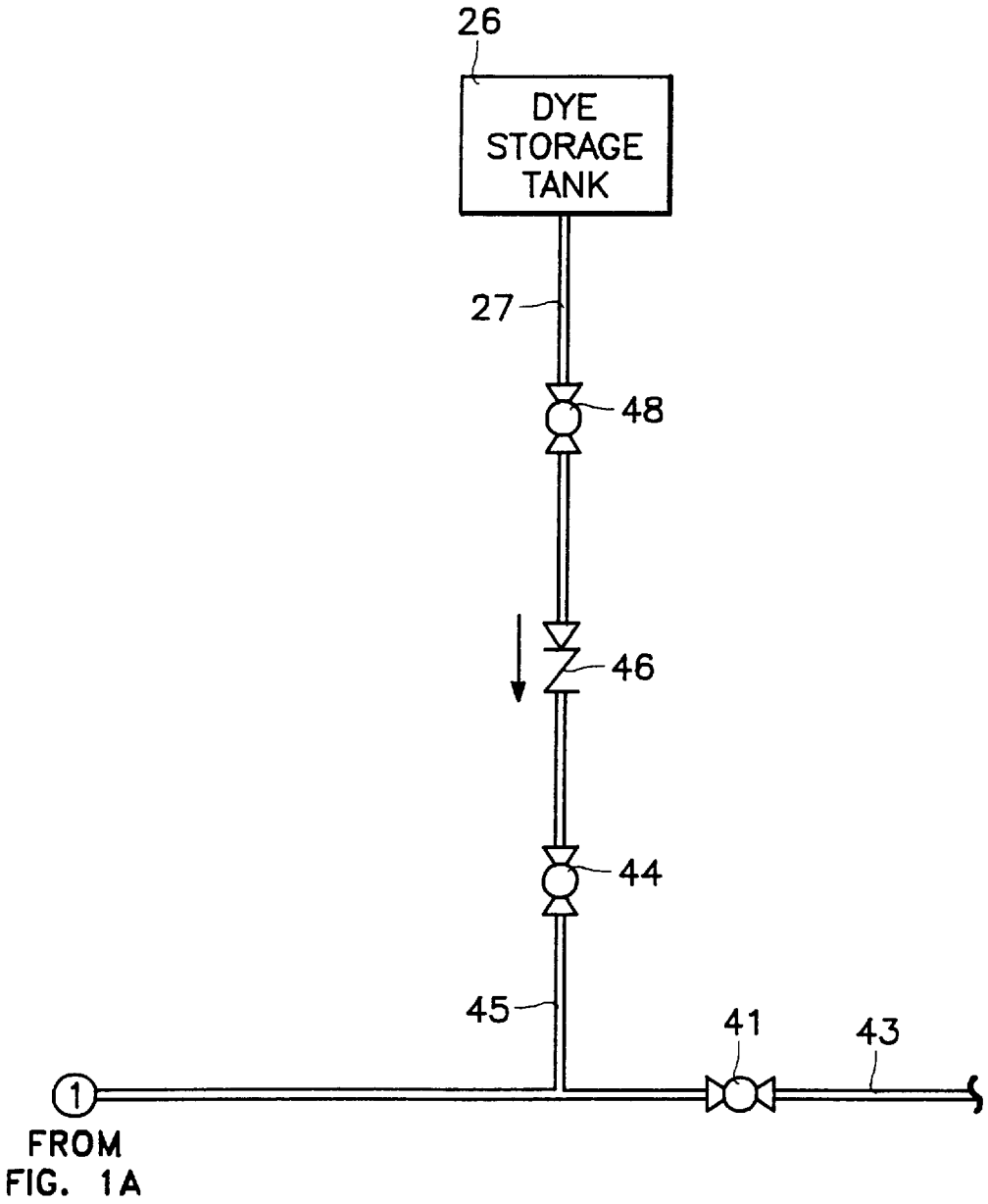

Referring first to FIGS. 1A and 1B, there is shown a fluid flow diagram for a foam free test kit/system 10 which may be used to test fire fighting vehicles, shipboard fire fighting systems, aircraft hanger automated sprinkler systems, fire trucks and the like equipped with fire fighting foam distribution systems.

Foam free test kit/system 10 comprises a three way ball valve 12 having a first inlet port A connected by a line 14 to a foam storage tank 16 which is used for the storage of aqueous film forming foam and has a capacity of about 156 gallons. Three way ball valve 12 also has an inlet port B connected by a line 18 to a water tank inlet pipe 20 and a winterization pipe 21. Water tank inlet pipe 20 is connected to a water storage tank 19 which is used for water storage. Similarly, winterization pipe 21 is connected to a winterization system (not illustrated) utilized by the Amertek CF4000L crash fire rescue vehicle which is one of the fire fighting vehicle for U.S. Military shore base airfield facilities throughout the world.

At this time it should be noted that the foam free test kit 10 illustrated in FIGS. 1A and 1B is adapted for use with the Amertek CF4000L crash fire rescue vehicle. The Amertek CF4000L crash fire rescue vehicle has four different nozzle types including a roof turret nozzle rated at 500 GPM; a bumper turret nozzle rated at 250 GPM; a handline nozzle rated at 60 GPM and three undertruck nozzles with the three nozzles being rated at 45 GPM. The fire pump for the Amertek CF4000L crash fire rescue vehicle has a rating of 900 GPM at 200 PSI. Water tank capacity for the crash fire rescue vehicle is 1050 gallons.

The outlet port C of three way ball valve 12 is connected by a line 22 to a fluid flow sensor 24 which measures flow rate of aqueous film forming foam through three way ball valve 12 when foam is being provided for fire fighting operations. Fluid flow sensor 24 also measures water flow rate through three way ball valve 12 when dye from a dye storage tank/bottle 26 is used to test the fire fighting system associated with test kit/system 10. Fluid flow sensor 24 is coupled to a digital flow monitor 28 which is a digital display. Fluid flow sensor 24 is mounted on the control panel 30 for test kit/system 10.

At this time it should be noted that three way ball valve 12 includes a normally closed position indicating switch 49 which when closed indicates that flow path AC of ball valve 12 is opened. Three way ball valve 12 also includes a normally open position indicating switch 52 which when closed indicates that flow path BC of ball valve 12 is open.

Fluid flow sensor 24 is a paddle wheel type flow meter that transmits a sine wave to a signal conditioner which converts the signal to a 5 volt pulse which is supplied to a digital flow monitor 28. Fluid flow sensor 24 comprises a paddle wheel 59 which measures the rate of fluid flow through line 22 in gallons per minute. Digital flow monitor 28 is a digital monitor which allows a fire fighting operator to read foam free dye water or concentrate aqueous film forming foam flow on the monitor for verification of system performance. As an example, the operator of test kit/system 10 could expect to read a flow value of 30 GPM for six percent concentrate aqueous film forming foam and 15 GPM for three percent concentrate aqueous film forming foam through the roof turret nozzle of CF4000L crash fire rescue vehicle at a pump discharge pressure of 240 psi. Expected flow rates of aqueous film forming foam through sensor 24 range from about 1.35 GPM for a three percent concentrate aqueous film forming foam to about 30 GPM for a six percent aqueous film forming foam.

Fluid flow sensor 24 is connected to a back flow check valve 36 by a line 23. Connected to line 23 by a line 55 is a ball valve 54. Ball valve 54 when opened is used to drain tank 16 of aqueous film forming foam and when empty to refill tank 16.

Three way ball valve 12 includes an air operated/pneumatic solenoid valve 32 which controls the opening and closing of flow paths AC and BC valve 12 allowing either foam concentrate from tank 16 or water from tank 20 to flow through valve 12. Air operated solenoid valve 32 is connected to a pneumatic/air supply tank 34 which supplies compressed air to solenoid valve 32.

During normal operation flow path AC of three way ball valve 12 is open allowing foam concentrate to flow from tank 16 of test kit/system 10 through fluid flow sensor 24, a back flow check valve 36, an air activated ball valve 38, proportioner 40 and eductor 42 to a discharge line 57. Proportioner 40 is used to control the flow rate of foam concentrate from foam storage tank 16 to eductor 42. Proportioning of aqueous film forming foam into the water system is automatic and controlled through a fixed nonadjustable orifice plate within proportioner 40. Either a six percent orifice plate or a three percent orifice plate may be used with proportioner 40. Connected to proportioner 40 is a ball valve 41. Ball valve 41, which is manually operated, allows for drainage of proprotioner 40 through valve 41 to proportioner drain line 43.

Whenever system 10 is operational ball valve 38 is open and ball valve 39 is closed. It should be noted that ball valve 38 and ball valve 39 are connected to a source 37 of compressed air.

A six percent foam concentrate or a three percent foam concentrate flows from foam storage tank 16 through valve 38 and proportioner 40 to eductor 42. Water from water storage tank 19 also flows to eductor 42 through a line 47. A vacuum is created within eductor 42 drawing the foam concentrate into eductor 42 which then mixes the concentrate with water from line 47. The water foam concentrate mixture is supplied by eductor 42 through discharge line 57 to the Amertek CF4000L foam distribution system for use in fighting and extinguishing hydrocarbon and other flammable liquid fires.

Ball valve 39 is only open when Aqeous Film Forming Foam is being flushed out of the foam distribution system allowing water from water storage tank 19 to flow from tank 19 through ball valve 39, proportioner 40 to eductor 42.

Referring to FIGS. 1A, 1B, 2 AND 3, the dye piping system for test kit/system 10 includes dye storage bottle/tank 26 which is used to store the dye concentrates for testing the fire fighting vehicle's foam distribution system without environmental damage to the ground or impacting waste water treatment facilities. The dye concentrates selected for use with test kit 10 comprise an environmentally benign and biodegradable yellow green liquid concentrate and FLT dark blue liquid.

Connected to the outlet port of bottle/tank 26 by a line 27 is a needle valve 48 which meters the dye flow rate from bottle/tank 26. Needle valve 48 is preset to a position "two" and then locked into this position to insure that a sufficient amount of dye concentrate flows through system 10 to allow the operator to visually monitor the flow of dye through system 10. Connected to needle valve 48 is a check valve 46 which prevents back flow of fluids into dye storage bottle/tank 26.

Check valve 46 is connected to a dye solenoid valve 44 which is opened to allow dye concentrate to flow from dye storage botle/tank 26 through needle valve 48 and check valve 46, a Tee shaped line 45 into proportioner 40.

The normally closed dye solenoid valve 44 is operated by a DYE ON-DYE OFF switch 51 on control panel 30 which is located in the cab of the CF4000L crash fire rescue vehicle. DYE ON-DYE OFF switch 51 is turned to the DYE ON position (L position in FIG. 2) to energize solenoid valve 44 which opens valve 44 allowing dye concentrate to flow from dye storage bottle/tank 26 through valve 44 to proportioner 40. DYE ON-DYE OFF switch 51 is turned to the DYE OFF position (J position in FIG. 2) to de-energize solenoid valve 44 which closes valve 44 which prevents dye concentrate from flowing from dye storage bottle/tank 26.

Figure 2:
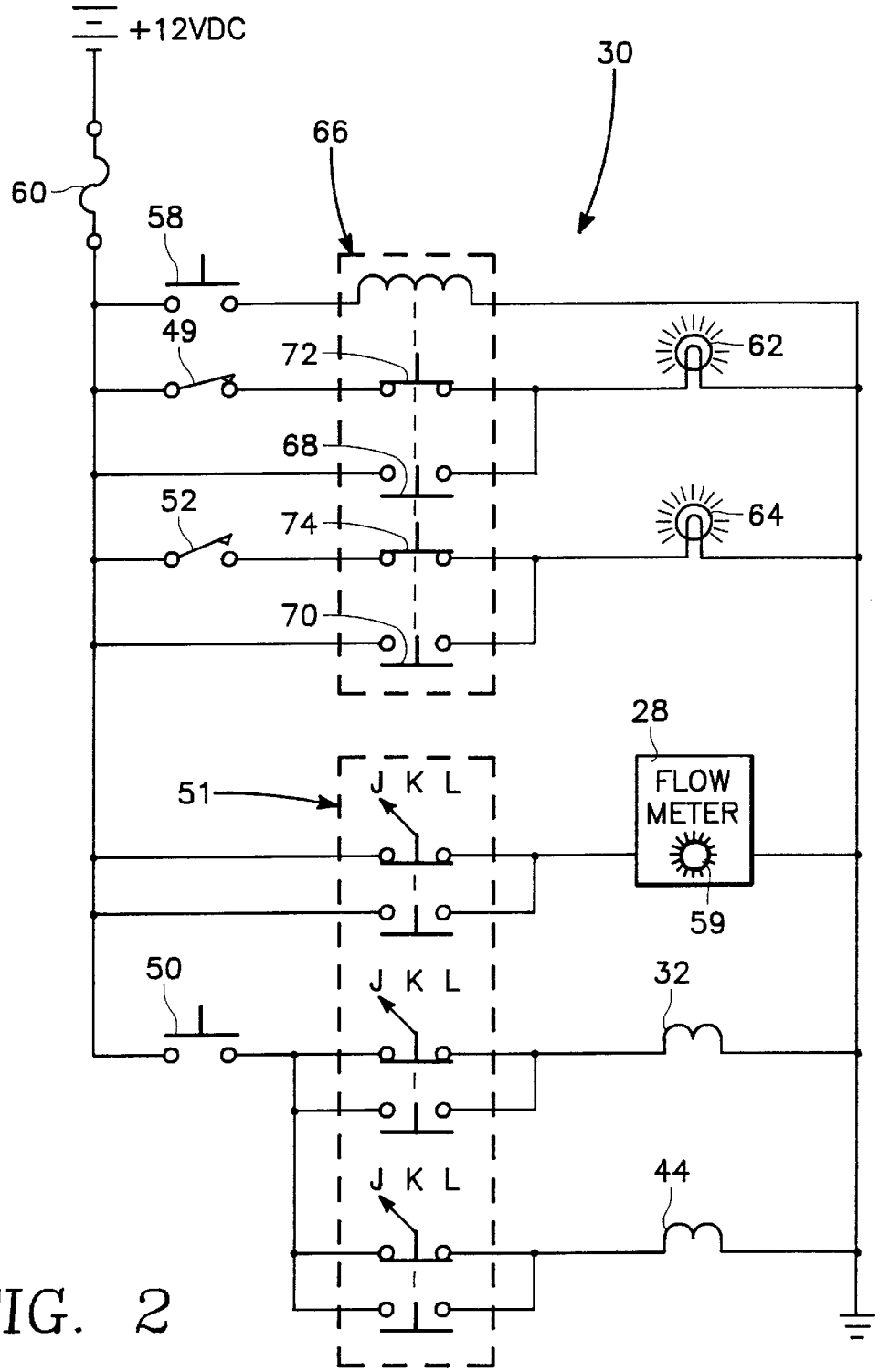
FIG. 2 is an electrical schematic diagram of the control system for the foam free test kit of FIG. 1.
Figure 3:
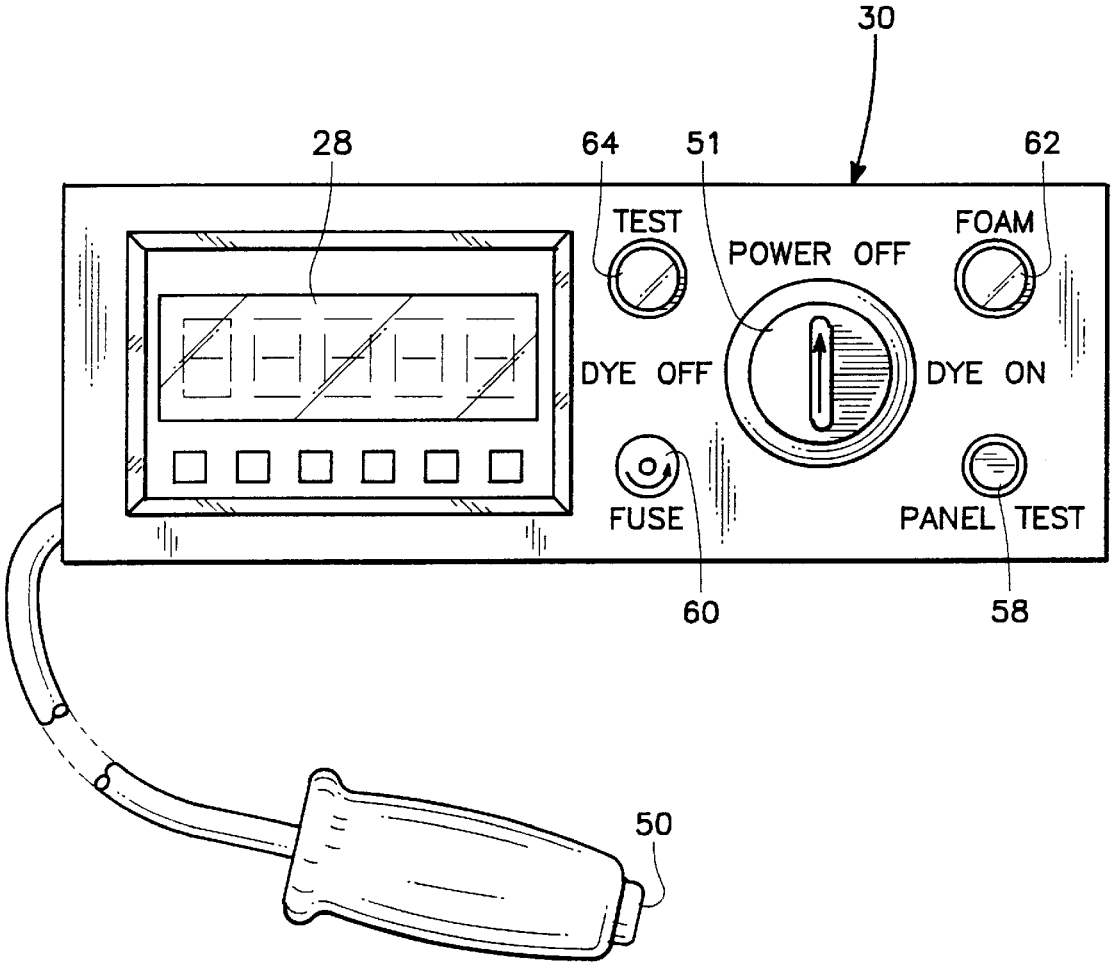
FIG. 3 is front view of the test kit control panel for the foam free test kit of FIG. 1.

Referring to FIGS. 1A, 1B and 2, solenoid valve 32 is opened and closed by a spring loaded hand held push button switch 50 positioning ball valve 12 to either the AC fluid flow path or the BC fluid flow path. By depressing push button switch 50, solenoid valve 32 is opened resulting in fluid flow through valve ports BC of three way ball valve 12 allowing for a foam free dye water system test of system 12. Releasing switch 50 closes solenoid valve 32 which opens ports AC of three way ball valve 12 allowing for the flow of aqueous film forming foam through valve 12.

Control panel 30 is located in the cab of Amertek CF4000L crash fire rescue vehicle and consist of power/dye control switch 51, digital flow monitor 28, fuse 60, a green foam indicator light 62, a red test indicator light 64, push button switch 50 and a push button lamp test switch 58.

Lamp test switch 58 on control panel 30 is used to test green foam indicator light 62 and red test indicator light 64. Depressing switch 58 energizes relay coil 66 closing normally open contacts 68 and 70 which activates green light 62 and red light 64 indicating that lights 62 and 64 are operational. Fuse 60 is an electrical protection device for control panel 30 which protects control panel 30 against overload.

During the dye-water foam-free system tests of system 10, an operator depresses hand held push button switch 50 while reading the digital flow monitor 28. This opens pneumatic solenoid valve 32 and activates ball valve 12 to the "BC" port position which is indicated by the red test light 64 on control panel 30. It should be noted switch 52 is also closed which completes a 12 VDC electrical signal path through switch 52 and contact 74 to red test light 64 when the vehicle fire pump is turned off.

At the completion of the dye-water foam-free system tests the hand held switch 50 is released, thereby closing the pneumatic solenoid valve 32 switching ball valve 12 to the "AC" port position. The light indication on control panel 30 will change from red to green and the digital flow monitor 28 will read zero.

The power/dye control switch 51 on control panel 30 is a three-position switch. Switch 51 is either in the dye ON position for dye concentrate introduction into the dye-water foam-free system test, dye OFF positionor or power OFF middle position with no power being supplied valves 32 and 44 of control panel 30 as well as monitor 28. Power/dye control switch 51 when in the dye ON or dye OFF position does not effect the monitor flow readings provided by monitor 28. Dye from dye storage bottle/tank 26 provides a quick indication to the operator of the foam distribution system performance.

From the foregoing description, it may readily be seen that the present invention comprises a new, unique and exceedingly system for the environmentally friendly testing of fire fighting vehicles equipped with fire fighting foam distribution systems which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A foam free test system adapted for testing a foam distribution system of a fire fighting vehicle comprising:

a foam storage tank having an outlet port, said foam storage tank having an aqueous film forming foam stored therein;

a water storage tank having an outlet port, said water tank providing a pressurized liquid;

a three way ball valve having a first inlet port connected to the outlet port of said foam storage tank, a second inlet port connected to the outlet port of said water storage tank and an outlet port;

said three way ball valve providing a first fluid flow path from said first inlet port of said three way ball valve to said outlet port of said three way ball valve whenever said three way ball valve is not at an active state;

said three way ball valve providing a second fluid flow path from said second inlet port of said three way ball valve to said outlet port of said three way ball valve whenever said three way ball valve is at said active state, said aqueous film forming foam flowing along said first fluid flow path through said three way ball valve whenever said three way ball valve is not at said active state, said pressurized liquid flowing along said second fluid flow path through said three way ball valve whenever said three way ball valve is at said active state;

activating means coupled to said three way ball valve for activating said three way ball valve to said active state;

monitoring means coupled to said three way ball valve for monitoring a rate of flow of said aqueous film forming foam through said monitoring means, said monitoring means having a digital display means for providing a visual display of said rate of flow of said aqueous film forming foam through said monitoring means;

proportioner means connected to said monitoring means for controlling said rate of flow of said aqueous film forming foam from said foam storage tank, said proportioner means including an orifice plate to control said rate of flow of said aqueous film forming foam; and eductor means having a first inlet port connected to the outlet port of said water storage tank to receive said pressurized liquid and a second inlet port connected to said proportioner means, said pressurized liquid creating a vacuum within said eductor means as said pressurized liquid flows through said eductor means, said vacuum drawing said aqueous film forming foam into said eductor means, said eductor means mixing said pressurized liquid and said aqueous film forming foam to form a liquid foam concentrate mixture.

2. The foam free test system of claim 1 further comprising:

a dye storage tank having an outlet port, said dye storage tank having a dye concentrate stored therein;

a needle valve having an inlet port connected to the outlet port of said dye storage tank and an outlet port;

a check valve having an inlet port connected to the outlet port of said needle valve and an outlet port; and a dye solenoid valve having an inlet port connected to the outlet port of said check valve and an outlet port connected to an inlet-outlet port of said proportioner means.

3. The foam free test system of claim 2 wherein said dye concentrate comprises a biodegradable yellow-green dye.

4. The foam free test system of claim 2 wherein said dye concentrate comprises a biodegradable blue dye.

5. A foam free test system adapted for testing a foam distribution system of a fire fighting vehicle comprising:

a foam storage tank having an outlet port, said foam storage tank having an aqueous film forming foam stored therein;

a water storage tank having an outlet port, said water tank providing a pressurized liquid;

an air supply tank having an outlet port, said supply tank providing a pressurized gas;

a pneumatic solenoid valve having an inlet port connected to the outlet port of said air supply tank and an outlet port;

an air operated valve having an A inlet port connected to the outlet port of said foam storage tank, a B inlet port connected to the outlet port of said water storage tank, a C outlet port and a pneumatic inlet port connected to the outlet port of said pneumatic solenoid valve;

a first check valve having an inlet port connected to the C outlet port of said air operated valve;

a first ball valve having an inlet port connected to the outlet port of said first check valve and an outlet port;

a second ball valve having an inlet port connected to the outlet port of said water storage tank and an outlet port;

a proportioner having an inlet port connected to the outlet port of said first ball valve and the outlet port of said second ball valve, an inlet-outlet port and an outlet port;

a dye storage tank having an outlet port, said dye storage tank having a dye concentrate stored therein;

a needle valve having an inlet port connected to the outlet port of said dye storage tank and an outlet port;

a second check valve having an inlet port connected to the outlet port of said needle valve and an outlet port;

a dye solenoid valve having an inlet port connected to the outlet port of said second check valve and an outlet port connected to the inlet-outlet port of said proportioner; and an eductor having a first inlet port connected to the outlet port of said water storage tank and a second inlet port connected to the outlet port of said proportioner.

6. The foam free test system of claim 5 wherein said air operated valve comprises a three way ball valve.

7. The foam free test system of claim 5 further comprising a fluid flow sensor coupled between the C outlet port of said air operated valve and the inlet port of said first check valve.

8. The foam free test system of claim 7 further comprising a digital flow monitor electrically coupled to said fluid flow sensor.

9. The foam free test system of claim 5 comprising a third ball valve having an inlet port connected to the inlet-outlet port of said proportioner and the outlet port of said dye solenoid valve.

10. The foam free test system of claim 5 wherein said dye concentrate comprises a biodegradable yellow-green dye.

11. The foam free test system of claim 5 wherein said dye concentrate comprises a biodegradable blue dye.

12. The foam free test system of claim 5 further comprising a hand held push button switch electrically connected to said pneumatic solenoid valve and said dye solenoid valve.

13. The foam free test system of claim 5 further comprising a discharge line, said discharge line being connected to an outlet port of said eductor and the foam distribution system of said fire fighting vehicle.

14. A foam free test system adapted for testing a foam distribution system of a fire fighting vehicle comprising:

a foam storage tank having an outlet port, said foam storage tank having an aqueous film forming foam stored therein;

a water storage tank having an outlet port, said water tank providing a pressurized liquid;

an air supply tank having an outlet port, said supply tank providing a pressurized gas;

a pneumatic solenoid valve having an inlet port connected to the outlet port of said air supply tank and an outlet port;

an air operated valve having an A inlet port connected to the outlet port of said foam storage tank, a B inlet port connected to the outlet port of said water storage tank, a C outlet port and a pneumatic inlet port connected to the outlet port of said pneumatic solenoid valve;

a first check valve having an inlet port connected to the C outlet port of said air operated valve;

a fluid flow sensor having an inlet port coupled to the C outlet port of said air operated valve, said fluid flow sensor having an outlet port coupled to the inlet port of said first check valve;

a digital flow monitor electrically coupled to said fluid flow sensor;

a first ball valve having an inlet port connected to the outlet port of said first check valve and an outlet port;

a second ball valve having an inlet port connected to the outlet port of said water storage tank and an outlet port;

a proportioner having an inlet port connected to the outlet port of said first ball valve and the outlet port of said second ball valve, an inlet-outlet port and an outlet port;

a dye storage tank having an outlet port, said dye storage tank having a dye concentrate stored therein;

a needle valve having an inlet port connected of said dye storage tank and an outlet port;

a second check valve having an inlet port connected to the outlet port of said needle valve and an outlet port;

a dye solenoid valve having an inlet port connected to the outlet port of said second check valve and an outlet port connected to the inlet-outlet port of said proportioner;

an eductor having a first inlet port connected to the outlet port of said water storage tank and a second inlet port connected to the outlet port of said proportioner; and a third ball valve having an inlet port connected to the inlet-outlet port of said proportioner and the outlet port of said dye solenoid valve.

15. The foam free test system of claim 14 wherein said air operated valve comprises a three way ball valve.

16. The foam free test system of claim 14 wherein said dye concentrate comprises a biodegradable yellow-green dye.

17. The foam free test system of claim 14 wherein said dye concentrate comprises a biodegradable blue dye.

18. The foam free test system of claim 14 further comprising a hand held push button switch electrically connected to said pneumatic solenoid valve and said dye solenoid valve.

19. The foam free test system of claim 14 further comprising a discharge line, said discharge line being connected to an outlet port of said eductor and the foam distribution system of said fire fighting vehicle.

20. The foam free test system of claim 13 further comprising a fourth ball valve having inlet port connected to the outlet port of said fluid flow sensor.

* * * * *